US006123660A

United States Patent [19]

Leysieffer

[11] Patent Number: 6,123,660

[45] Date of Patent: Sep. 26, 2000

[54] PARTIALLY OR FULLY IMPLANTABLE HEARING AID

[75] Inventor: Hans Leysieffer, Taufkirchen, Germany

[73] Assignee: Implex Aktiengesellschaft Hearing Technology, Ismaning, Germany

[21] Appl. No.: 09/311,563

[22] Filed: May 14, 1999

[30] Foreign Application Priority Data

Sep. 3, 1998 [DE] Germany ..... 198 40 211

[51] Int. Cl.[7] ..... H04R 25/00

[52] U.S. Cl. ..... 600/25; 607/57

[58] Field of Search ..... 600/25; 607/55–57; 381/312, 328; 623/10, 11; 181/126, 130, 135

[56] References Cited

U.S. PATENT DOCUMENTS

| | | | |
|---|---|---|---|
| 3,870,832 | 3/1975 | Fredrickson . | |
| 4,628,907 | 12/1986 | Epley et al. . | |
| 4,800,884 | 1/1989 | Heide et al. . | |
| 5,259,032 | 11/1993 | Perkins et al. . | |
| 5,277,694 | 1/1994 | Leysieffer et al. . | |
| 5,360,388 | 11/1994 | Spindel et al. | 600/25 |
| 5,411,467 | 5/1995 | Hortmann et al. | 600/25 |
| 5,624,376 | 4/1997 | Ball et al. . | |
| 6,005,955 | 12/1999 | Kroll et al. | 381/328 |

*Primary Examiner*—Cary O'Connor
*Assistant Examiner*—Catherine McPherson
*Attorney, Agent, or Firm*—Nixon Peabody LLP; David S. Safran

[57] ABSTRACT

The invention relates to a transducer for partially or fully implantable hearing aids for direct mechanical excitation of the middle or inner ear. The transducer is provided with a housing fixedly mounted at the implantation site and a coupling element moveable with respect to the housing for transmitting vibration to the middle ear ossicle or directly to the inner ear. The housing accommodates a piezoelectric element with which the coupling element can be vibrated and an electromagnet arrangement including an electromagnetic component, such as an electromagnetic coil, fixedly mounted relative to the housing and a vibratory component, such as a permanent magnet, mechanically connected to the coupling element such that the vibration of the vibratory component is transferred to the coupling element.

21 Claims, 4 Drawing Sheets

PARTIALLY OR FULLY IMPLANTABLE HEARING AID

BACKGROUND OF THE INVENTION

1. Field of the Invention

This invention relates to the field of partially or fully implantable hearing aids comprising a transducer which provides direct mechanical excitation of the middle or inner ear. More specifically, this invention relates to such transducers including a housing which can be fixed at the implantation site and a coupling element which can move with respect to the housing, the housing accommodating a piezoelectric element by which the coupling element can transmit vibrations from the piezoelectric element to the middle ear ossicle or directly to the inner ear.

2. Description of Related Art

A transducer of this general type is illustrated in U.S. Pat. No. 5,277,694. In this patent, it is proposed that one wall of the housing be made as a vibrating membrane with an electromechanically active heteromorphic composite element with a piezoelectric ceramic disk attached to the side of the membrane inside the housing. Generally good results have been obtained with a hearing aid transducer built in this manner. However, it has been found that at low frequencies, the coupling element driven by the piezoelectric ceramic disk does not create sufficient deflections to provide adequate loudness level for patients with medium and more serious hearing loss. This insufficient deflection has been attributed, in part, to be caused by the low electrical voltages required for such implants.

U.S. Pat. No. 5,624,376 discloses a transducer for partially or fully implantable hearing aids based on the electromagnetic principle in which a permanent magnet is permanently joined to hermetic housing. An induction coil which interacts with the magnet is permanently joined to the housing wall which is made as a vibratory membrane. On the side of the vibratory membrane outside the housing, the vibratory membrane is provided with a clip element which attaches the transducer to the incus. As AC voltage is applied to the induction coil, the magnet within the housing is displaced thereby causing vibrational excitation of the incus.

The disadvantage of hearing aids provided with these electromagnetic transducers is that the transducer deflection at high frequencies can be too small to achieve a sufficient loudness level for the user. It has been found that in such electromagnetic systems, the electrical impedance increases simultaneously at higher frequencies because of the inductive component. Therefore, broadband electromagnetic systems, for example, those which allow transmission up to 10 kHz, have a high power consumption when compared to piezoelectric systems.

Therefore, there exists an unfulfilled need for partially or fully implantable hearing aids comprising transducers which provide direct mechanical excitation of the middle or inner ear at a sufficient loudness levels at a wide range of frequencies. There also exists an unfulfilled need for such hearing aids which use relatively little amount energy.

SUMMARY OF THE INVENTION

In view of the forgoing, the primary object of the present invention is to devise a hearing aid comprising a transducer which is mechanically coupled to a middle ear ossicle or directly to the inner ear for transmission of vibration.

A second object of the present invention is to devise a hearing aid comprising a transducer of the initially mentioned type which can generate sufficient deflection to achieve sufficient loudness level at a wide range of frequencies.

Yet another object of the present invention is to devise a hearing aid comprising a transducer which accomplishes the above objectives and at the same time, uses relatively little energy.

These objects are achieved by providing a hearing aid which comprises a transducer including a housing accommodating a piezoelectric element and an electromagnet arrangement. The electromagnet arrangement includes an electromagnetic component which is fixed relative to the housing and a vibratory component which is connected to the coupling element such that the vibrations of the vibratory component are transferred to the coupling element.

The present invention has advantages over the prior art hearing aids in that the frequency response of the transducer can be improved as compared to purely piezoelectric and also purely electromagnetic systems so that sufficient loudness level is attained. Additionally, the present invention provides flat frequency response with respect to the deflection of the coupling element over a wide frequency band, even when the stimulation levels are high while at the same time, maintaining low power consumption.

More specifically, in one preferred embodiment, one wall of the transducer housing may be made to vibrate and thus, may be formed as a vibratory membrane. The vibratory membrane may be provided with a piezoelectric element attached to the side of the membrane inside the housing, and a coupling element connected to the side of the membrane outside the housing. The combination of the passive vibratory membrane and the active piezoelectric element which may be disk-shaped, forms a heteromorphic, piezoelectric bending oscillator. In the oscillator, the theoretical change in the radius of the disk-shaped piezoelectric element, which would occur upon application of an electrical voltage to the piezoelectric element, is transformed into bending of the composite element perpendicularly to the plane of the plate thereby allowing large deflections at small voltages at the higher frequencies.

Furthermore, in a transducer of a hearing aid in accordance with the present invention, an electromagnet arrangement is provided in conjunction with the piezoelectric element. A vibratory component of the electromagnet arrangement is connected to the side of the piezoelectric element inside the housing and may be made as a permanent magnet. In addition, the electromagnet arrangement includes an electromagnetic component fixedly attached in the housing. The electromagnetic component may be an electromagnetic coil thereby causing the vibratory component such as a permanent magnet to vibrate when voltage is applied to the electromagnetic component. This represents especially feasible coupling of the electromagnet arrangement and the piezoelectric element.

According to one modified embodiment, the permanent magnet may be directly connected to the vibratory membrane through a center opening in the piezoelectric element.

In other embodiments, the transducer of the hearing aid of the present invention may have associated thereto a control arrangement which selectively causes the piezoelectric element and/or the electromagnet arrangement to vibrate. This allows optimization of the frequency response of the transducer such that only the piezotransducer or the electromagnetic transducer is operated or both may be operated simultaneously.

Preferred embodiments of this invention are described below with reference to the attached drawings.

DETAILED DESCRIPTION OF THE INVENTION

Figure 1:
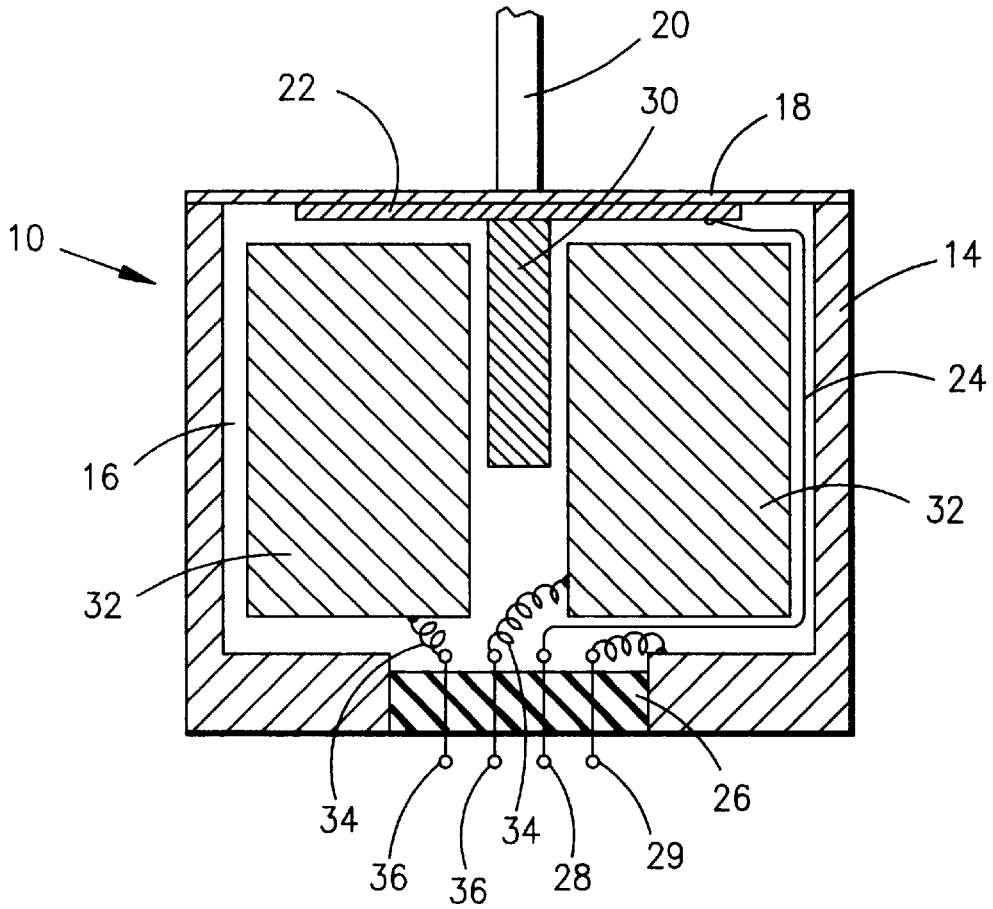
FIG. 1 illustrates a sectional view of a transducer for a hearing aid in accordance with one embodiment of the present invention.
Figure 2:
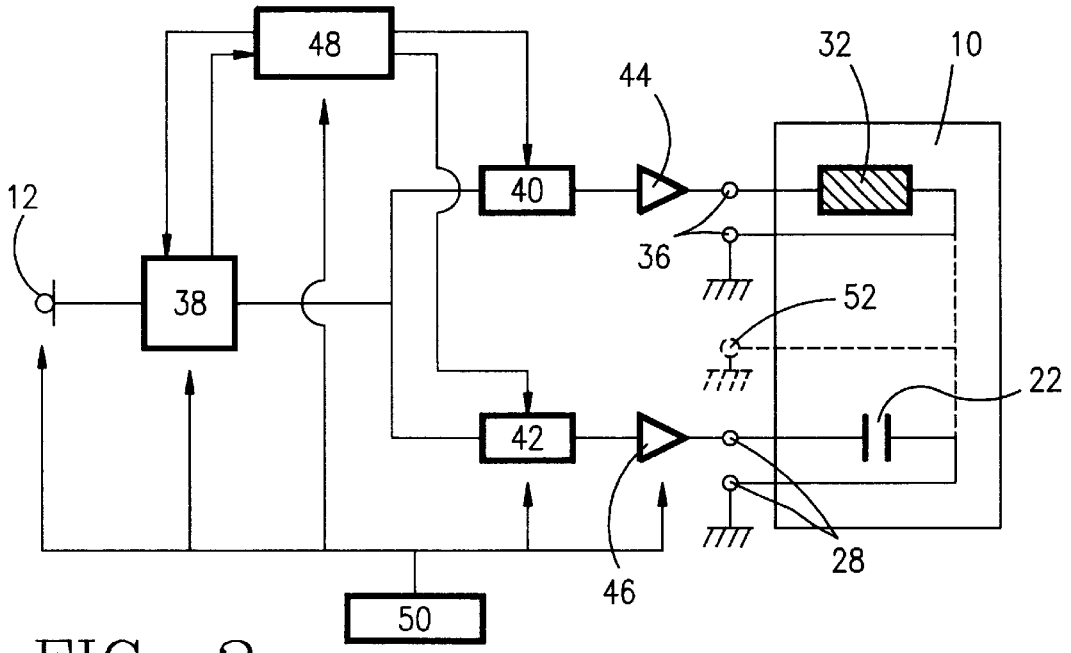
FIG. 2 shows an electrical schematic of a hearing aid comprising the transducer of FIG. 1.

FIG. 1 illustrates an implantable transducer 10 for a hearing aid for direct mechanical excitation of the middle or inner ear in accordance with one embodiment of the present invention. A detector such as a microphone 12 (as shown in FIG. 2) may be provided and is preferably, implanted to receive sound. As FIG. 1 illustrates, the transducer 10 includes a hermetically sealed, biocompatible cylindrical housing 14 which is made of an electrically conductive material. The housing 14 may be filled with an inert gas 16. One end wall of the housing 14 is made as an electrically conductive vibratory membrane 18 which is provided with a coupling element 20 on the side of the vibratory membrane 18 outside of the housing 14 for mechanical vibrational coupling to a middle ear ossicle or to an inner ear. The vibratory membrane 18 is also provided with a piezoelectric element 22 such as a thin piezodisk made from a piezoelectric material, for example, lead zirconate titanate (PZT) on the side inside of the housing 14. The piezoelectric element 22 is attached to the membrane 18 by means of an electrically conductive adhesive connection and is electrically connected to terminal 28 by a thin flexible wire 24. The terminal 28 is positioned outside of the housing 14 through a hermetic feed-through means 26. The Around pole 29 is also routed via the feed-through means 26 to the inside of the housing 14. Application of an electrical voltage to the terminal 28 causes the hetero-composite of the vibratory membrane 18 and the piezoelectric element 22 to flex and thus, leads to deflection of the vibratory membrane 18. This deflection is transmitted via the coupling element 20 to a middle ear ossicle or directly to the inner ear (not shown). The coupling element 20 may be made as a coupling rod and may be connected to the ossicular chain, for example, by a thin wire, hollow wire clip, or a clip of carbon-fiber reinforced composite (not shown). Housing 14, suitably, has a diameter in the range of 6 to 13 mm, preferably about 9 mm. The thickness of membrane 18 and piezoelectric element 22 are advantageously each in the range of 0.05 to 0.15 mm. Membrane 18 and piezoelectric element 22 are advantageously each of circular design, with the radius of membrane 18 preferably being greater than the radius of piezoelectric element 22 by a factor of 1.2 to 2.0. A factor of about 1.4 has proven especially advantageous. The transducer housing 14, including membrane 18, is made of a biocompatible material, preferably titanium, niobium, tantalum or their alloys, or of another biocompatible metal. Suitable arrangements of this type are described in commonly owned, co-pending U.S. patent application Ser. No. 09/042.805 which is hereby incorporated by reference.

The aspects of the present invention described thus far in the above discussion are generally known from U.S. Pat. No. 5,277,694 assigned to the assignee of the present invention and likewise incorporated herein by reference. However, as discussed previously, the deflection which can be achieved with a piezoelectric system can be too small for a proper hearing impression at low and middle frequencies. To improve the frequency response in this range, the transducer in accordance with the present invention is provided with both the piezotransducer and an electromagnetic transducer. In this regard, an electromagnet arrangement which includes an electromagnetic component 32 and a vibratory component 30 is provided in conjunction with the piezoelectric element 22 as will be discussed in further detail below.

In accordance with the present invention, the piezoelectric element 22 is permanently joined by means of adhesive, welding or solder to the vibratory component 30 of the electromagnet arrangement on the side facing away from the membrane 18 as illustrated in FIG. 1. The vibratory component 30 may be formed from a permanent magnet and be positioned within the electromagnetic component 32. The electromagnetic component 32 may be made as an electromagnetic coil or an electrical coil. In the preferred embodiment, the vibratory component 30 may be positioned to be movable within the electromagnetic component 32. The electromagnetic component 32 is permanently mounted within the housing 14 and is connected to terminals 36 by wires 34 which are guided to the outside the housing 14 through feed-through means 26. Excitation of the electromagnetic component 32 by application of an AC voltage to terminals 36 causes displacement of the vibratory component 30 relative to the housing-mounted electromagnetic component 32 thereby resulting in deflection of the vibratory membrane 18. The deflection caused by the vibratory component 30 may optionally be superimposed with the membrane deflection caused by the simultaneous application of voltage to the piezoelectric element 22 thereby increasing the deflection of the vibratory membrane 18. In this manner, the frequency response of the transducer 10 in accordance with the present invention can be improved by single or additional application of a corresponding signal-voltage to the electromagnetic component 32 via the terminals 36, especially in the low frequency range.

In order to more specifically explain the operation of the hearing aid provided with transducer 10, an electrical schematic is shown in FIG. 2 in accordance with one embodiment of the present invention which may be used in operating the transducer 10. The sound to be transmitted is converted by a microphone 12 into an electrical signal which is filtered and amplified in a signal processor 38. The output signal from the signal processing means 38 is sent to two parallel filters 40 and 42, each of which are connected in series to output amplifiers 44 and 46 respectively. The output amplifiers 44 and 46 are connected to the terminals 36 of the electromagnetic component 32 and terminals 28 of the piezoelectric element 22 respectively. A microcontroller 48 may be used to control the signal processor 38 and the parallel filters 40 and 42. In this regard, the microcontroller 48 receives information from the signal processor 38 regarding the composition of the signal being processed in the signal processor 38. All of these components including the microphone 12, the signal processor 38, the parallel filters 40 and 42, the microcontroller 48 and the output amplifiers 44 and 46 may be powered by a power supply which, in the preferred embodiment, is an implantable battery unit 50. In addition, all of these components and methods of signal processing are generally known in the electrical and electronic arts. Thus, their specific structures or the details as to their function need not be discussed in further detail.

The microcontroller 48 may control the parallel filters 40 and 42 such that, depending on the frequency or frequency focus of the signal being instantaneously processed in the signal processor 38, the piezoelectric element 22 and/or the electromagnetic component 32 may be selectively operated by excitation with the signal to be transmitted. In the preferred embodiment illustrated in FIGS. 1 and 2 microcontroller 48, filters 40 and 42 and output amplifiers 44 and 46 are disposed outside of the transducer housing 14; however some or all of these components also could be incorporated into the housing of transducer 10.

In the present embodiment, the microcontroller 48 can be designed such that in a first frequency band which extends from a first frequency $f_1$ to a cutoff frequency $f_T$, the electromagnetic component 32 may be operated to produce the vibrations to be transmitted to the coupling element 20. In a similar manner, the microcontroller 48 can be designed such that in a second frequency band which extends from the cutoff frequency $f_T$ to a second frequency $f_2$, the piezoelectric element 22 is operated to produce the vibrations to be transmitted to the coupling element 20. Of course, the microcontroller 48 can be programmed with respect to the cutoff frequency $f_T$ value according to the specific application and the patient's condition. Again, because all of the above discussed control methods and signal processing are generally known in the electrical and electronic arts, they need not be discussed in further detail.

In the above discussed embodiment which is shown in FIGS. 1 and 2, the electromagnetic component 32 such as an electromagnetic coil and the piezoelectric element 22, are conductively decoupled from one another. This allows the use of double bridge amplifiers for triggering the electromagnetic component 32 and the piezoelectric element 22. However, in an alternative embodiment, triggering of the electromagnetic component 32 and the piezoelectric element 22 can also be achieved by providing only one common ground terminal 52 for the electromagnetic component 32 and the piezoelectric element 22. This alternative modification is illustrated in FIG. 2 by broken lines which would replace the separate around terminals shown as solid lines. In this modified embodiment, a terminal wire 34 of the electromagnetic component 32 would then be connected on the inside to the housing 14 rather than being guided to the outside of the housing 14. This embodiment has the advantage in that there would only be three terminals on the transducer 10 and would also simplify the hermetic feedthrough means 26. As will be appreciated, the above discussed embodiments of the transducer 10 which separately trigger the electromagnetic component 32 and the piezoelectric element 22 have the distinct advantage of being highly flexible with respect to optimization of the transducer's 10 frequency response.

Figure 3A:
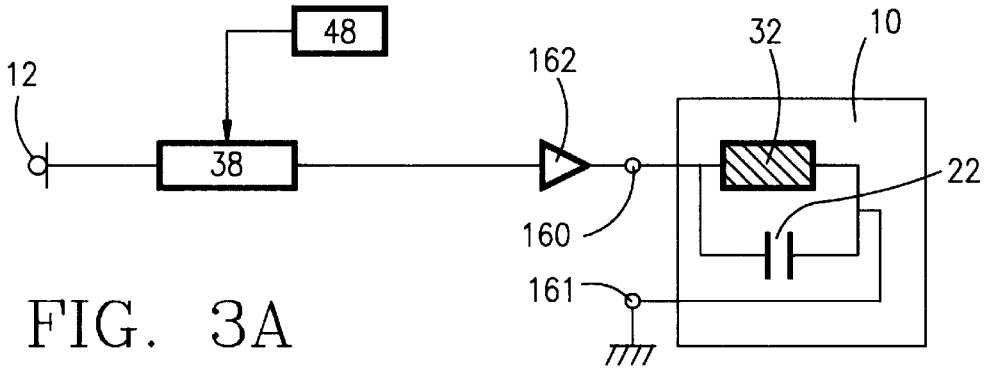
FIG. 3A shows, in schematic form, the wiring of a hearing aid comprising a transducer in accordance with another embodiment of the present invention.
Figure 3B:
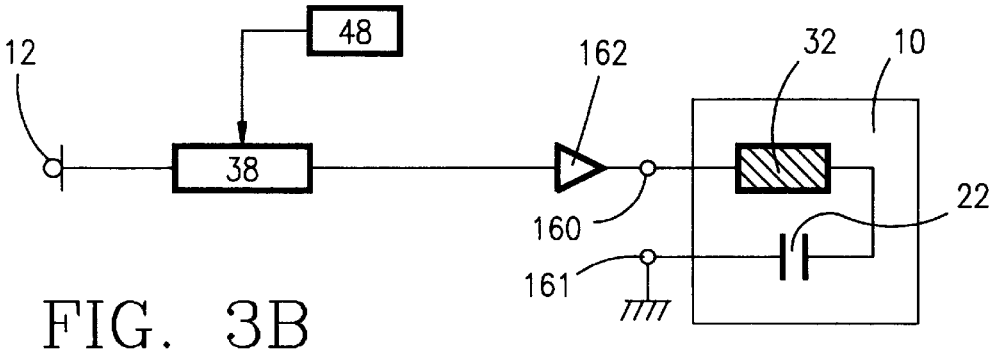
FIG. 3B shows an alternative wiring of a hearing aid having a transducer in accordance with yet another embodiment of the present invention.

FIGS. 3A and 3B show two embodiments in which separate triggering of the electromagnetic component 32 and the piezoelectric element 22 is eliminated in favor of simplification of the overall transducer 10. In these embodiments, only two terminals 160 and 161 must be routed out of the transducer 10, i.e. the housing 14. The electromagnetic component 32 and the piezoelectic element 22 can be connected in a parallel circuit as illustrated in FIG. 3A or alternatively, in a series circuit as illustrated in FIG. 3B. As in the embodiments shown in FIG. 2, the electrical signal generated by the microphone 12 is filtered and amplified in the signal processor 38 which is controlled by the microcontroller 48. At this point, the output signal can be supplied directly to an output amplifier 162 which is connected to the terminals 160 without additional filtering. Therefore, parallel filters 40 and 42 and an amplifier of the previous embodiment can be eliminated. It has been found that generally, parallel or series electrical connection yields an electrical resonant circuit which can adversely affect the transducer's 10 frequency response. This negative aspect, however, can be minimized and offset by proper selection of the mechanical components of the system. Thus, in either of these embodiments (parallel connection of FIG. 3A or series connection of FIG. 3B), both the electromagnetic component 32, and also the piezoelectric element 22, are operated so that the deflections of the membrane 18 and correspondingly, the coupling element 20, are produced by superimposing the vibrations of both the electromagnetic component 32 and the piezoelectric element 22. The frequency response of the transducer 10 thus follows from superposition of the frequency responses of the electromagnetic component 32 and the piezoelectric element 22 thereby allowing the generation of sufficient deflection to achieve sufficient loudness level at a wide range of frequencies. And by careful selection of the transducer's 10 mechanical components, strong deflection of the membrane 18 at both low frequencies and also high frequencies can be achieved.

Figure 4:
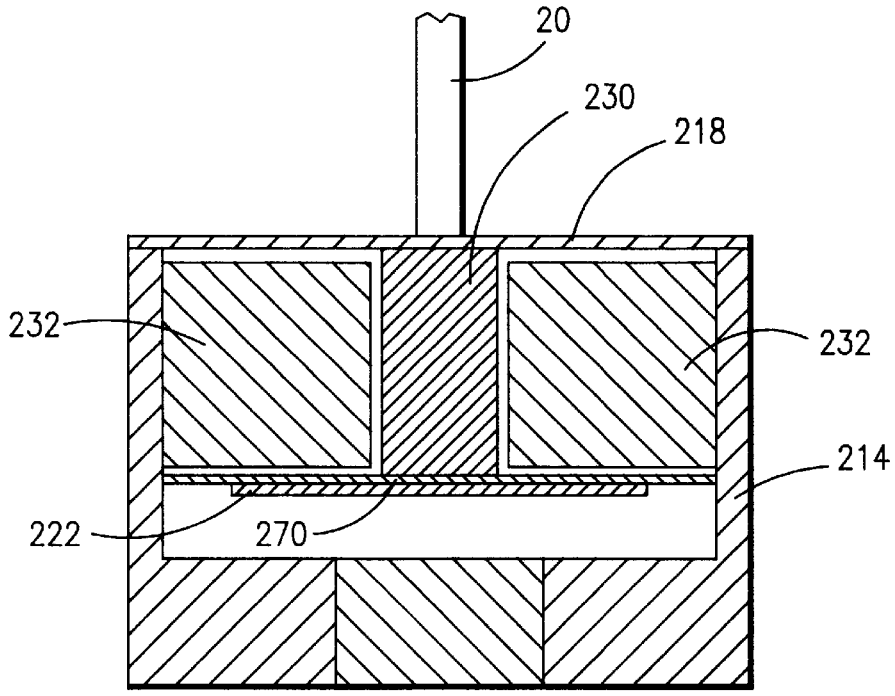
FIG. 4 illustrates a sectional view of another embodiment of a transducer for a hearing aid in accordance with the present invention.

FIG. 4 illustrates a sectional view of another embodiment of a transducer with an alternative mechanical coupling of the electromagnetic transducer and piezotransducer. Parallel to a first membrane 218 which forms one end wall of the housing 214, there is provided a second membrane 270 within the housing 214. On the bottom of the second membrane 270 on the side facing away from the first membrane 218, a piezoelectric element 222 is attached in order to excite the second membrane 270. On the top of the second membrane 270, one end of a vibratory component 230, such as a permanent magnet, is attached. The other end of the vibratory component 230 is attached to the first membrane 218 so that the vibratory component 230 provides for mechanical coupling of the first membrane 218 and the second membrane 270. The vibratory component 230 is arranged in a maimer similar to the prior embodiments allowing it to move and vibrate within an electromagnetic component 232 in response to operation of the electromagnetic component 232. Again, the electromagnetic component 232 may be an electromagnetic coil or an electrical coil. Thus, in this embodiment, the vibratory component 230 deflects both the first membrane 218 and the second membrane 270. When the piezoelectric element 222 is operated by applying a voltage to it, this causes deflection of the second membrane 270. This deflection in the second membrane 270 is transmitted through the mechanically coupled vibratory component 230 to the first membrane 218 which is deflected accordingly. Correspondingly, this deflection of the first membrane 218 causes vibrational displacement of the coupling element 20. The electrical operation and circuitry of the piezoelectric element 222 and the electromagnetic component 232 can be accomplished in the same maimer as described with respect to FIGS. 2, 3A and 3B, i.e. frequency-dependent separate triggering in isolation or with a common ground or common triggering in a parallel or series connection.

Figure 5:
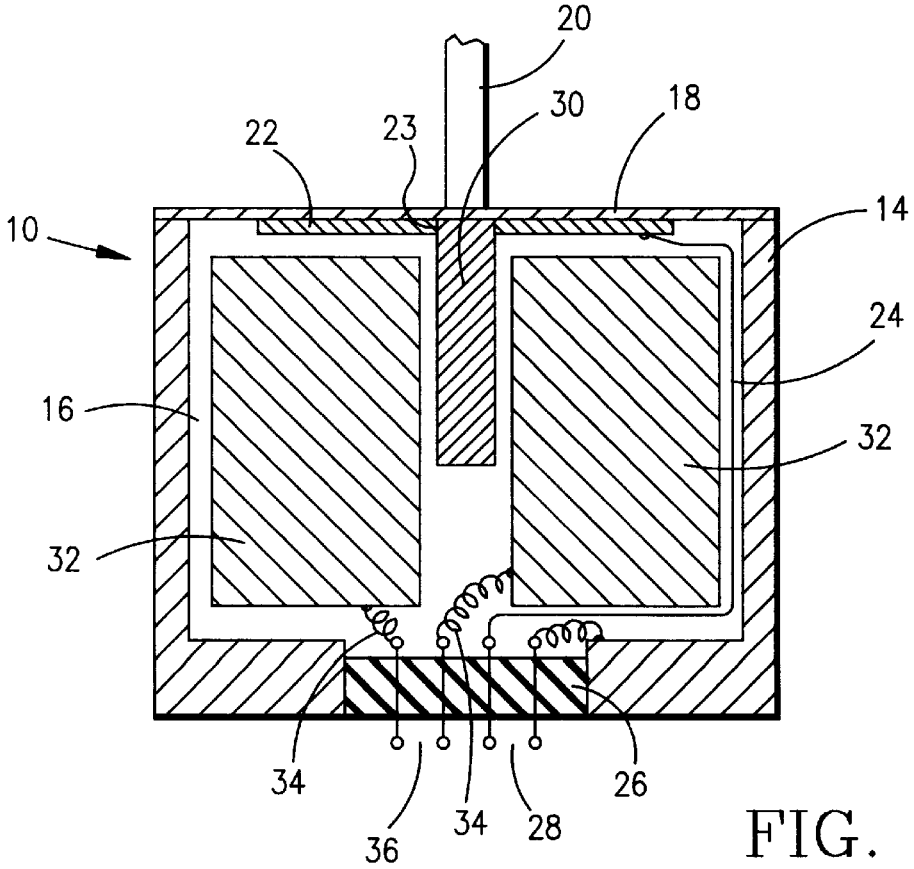
FIG. 5 illustrates a sectional view of yet another embodiment of a transducer for a hearing aid in accordance with the present invention.

The alternative embodiment illustrated in FIG. 5 differs from the embodiment illustrated in FIG. 1 only in that the vibratory component 30, such as a permanent magnet extends through a middle opening 23 of the piezoelectric element 22 and is securely connected to the vibratory membrane 18.

Figure 6:
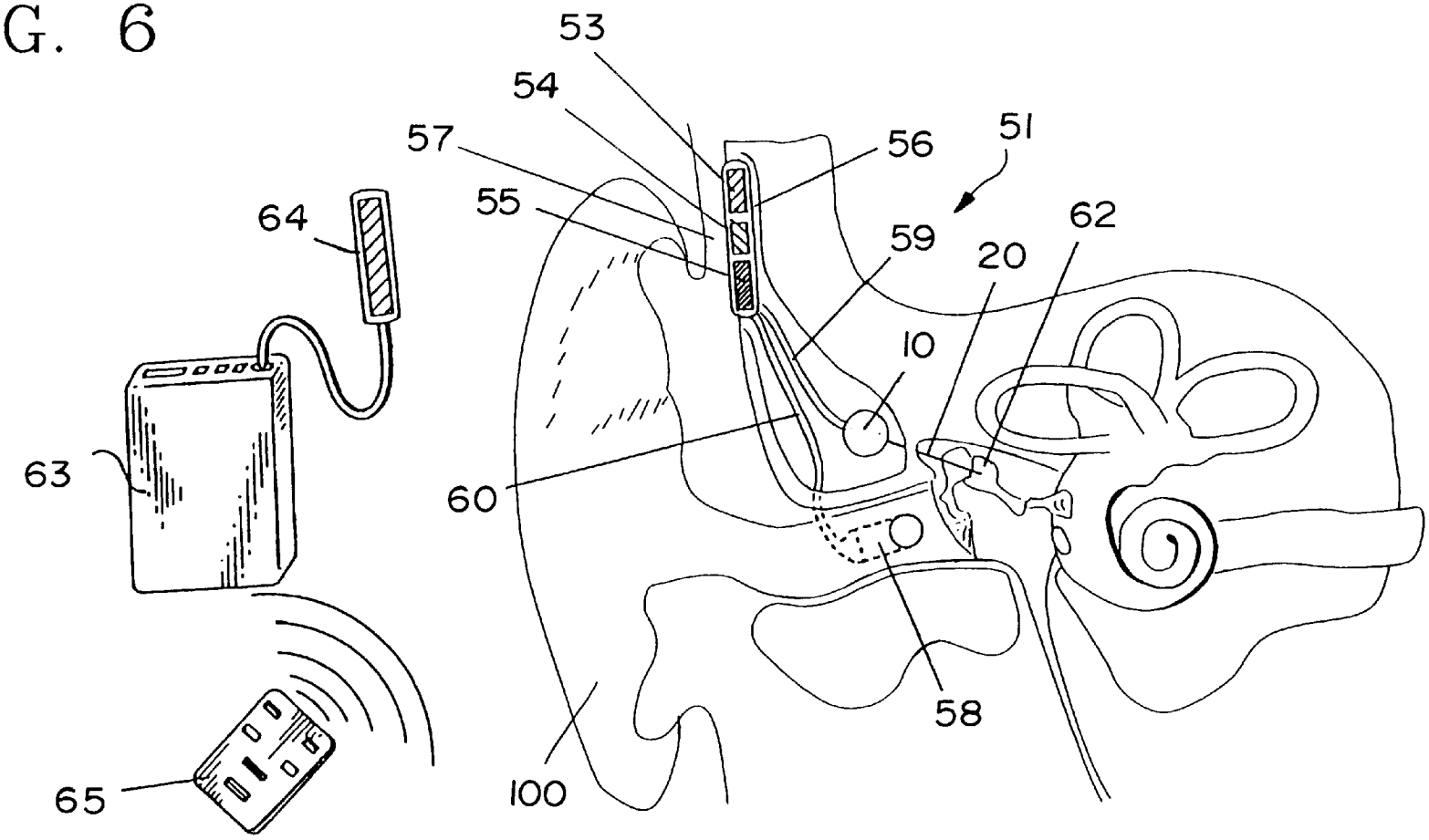
FIG. 6 shows a sectional view of a human ear with an implanted hearing aid in accordance with the present invention including a transducer such as those illustrated in FIGS. 1, 4, and 5.

FIG. 6 shows a hearing aid 51 which is equipped with a transducer 10 of the above described type as implanted in a human ear 100. The hearing aid 51 includes a battery unit 53, a charging reception coil 54, and all electronic module 55. These components are accommodated in a hermetically sealed housing 56 which can be implanted in the mastoid region 57. The transducer 10 and a microphone 58 are connected via wires 59 and 60 to the electronic module 55. The coupling element 20 (illustrated penetrating through an opening on the incus) is coupled to the ossicular chain 62. The portable charging unit 63 includes a charging transmission coil 64 which can be inductively coupled to the charging reception coil 54 for transcutaneous charging of the battery unit 53. A remote control unit 65 may also be provided. A hearing aid of this general type is exemplified in U.S. Pat. No. 5,277,694 and therefore, need not be discussed in further detail here While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

We claim:

1. An at least partially implantable hearing aid comprising a transducer for providing direct mechanical excitation of at least one of a middle ear and an inner ear, said transducer comprising a housing constructed for fixed mounting at an implantation site and a coupling element that is moveable with respect to said housing for transmitting vibration to said at least one of a middle ear and an inner ear, wherein said housing accommodates therein a piezoelectric element for vibrating said coupling element and an electromagnet arrangement including an electromagnetic component fixedly mounted relative to said housing and a vibratory component mechanically connected to said coupling element in a manner that vibration of said vibratory component is transferred to said coupling element.

2. Hearing aid of claim 1, wherein a wall of said transducer housing is a vibratory membrane with said piezoelectric element attached to a side of said vibratory membrane inside said housing and wherein said coupling element is connected to a side of said vibratory membrane outside said housing.

3. Hearing aid of claim 2, wherein said electromagnetic component is an electromagnetic coil and said vibratory component is a permanent magnet connected to said piezoelectric element, said electromagnetic coil being operable to cause vibration in said permanent magnet.

4. Hearing aid of claim 3, wherein said piezoelectric element has the shape of a thin disk.

5. Hearing aid of claim 2, wherein said vibratory component is a permanent magnet connected to said vibratory membrane through an opening in said piezoelectric element, said electromagnetic component being an electromagnetic coil which is operable to cause vibration in said permanent magnet.

6. Hearing aid of claim 1, wherein said housing is hermetically sealed and biocompatible.

7. Hearing aid of claim 1, further comprising a control unit for selectively operating at least one of said piezoelectric element and said electromagnet arrangement in a manner to cause at least one of said piezoelectric element and said electromagnet arrangement to vibrate.

8. Hearing aid of claim 7, wherein said control unit has means for selectively operating at least one of said piezoelectric element and said electromagnet arrangement in a manner dependent on frequency of vibration to be generated on said coupling element.

9. Hearing aid of claim 8, wherein said electromagnet arrangement is conductively decoupled from said piezoelectric element.

10. Hearing aid of claim 8, wherein said control unit has means for operating said electromagnet arrangement in a predetermined first frequency band extending from a first frequency of vibration to be produced on said coupling element to a cutoff frequency and for operating said piezoelectric element in a predetermined second frequency band extending from said cutoff frequency to a second frequency of the vibrations to be produced on said coupling element.

11. Hearing aid of claim 10, wherein frequency range of said predetermined first frequency band is lower than frequency range of said predetermined second frequency band.

12. Hearing aid of claim 10, wherein said control unit is programmable to fix said cutoff frequency.

13. Hearing aid of claim 1, wherein said electromagnet arrangement and said piezoelectric element are wired in a series electrical circuit.

14. Hearing aid of claim 1, wherein said electromagnet arrangement and said piezoelectric element are wired in a parallel electrical circuit.

15. Hearing aid of claim 1, wherein said piezoelectric element has the shape of a thin disk.

16. Hearing aid of claim 1, wherein said transducer housing has a circular cross section and has a diameter in the range of 6 to 13 mm.

17. Hearing aid of claim 2, wherein both said vibratory membrane and said piezoelectric element are circular.

18. Hearing aid of claim 17, wherein the thickness of said vibratory membrane and the thickness of said piezoelectric element are approximately the same.

19. Hearing aid of claim 17, wherein the said vibratory membrane has a radius that is greater than that of said piezoelectric element by a factor of 1.2 to 2.0.

20. Hearing aid of claim 1, wherein the thickness of said vibratory membrane and the thickness of said piezoelectric element are each in the range of 0.05 mm to 0.15 mm.

21. Hearing aid of claim 1, wherein said vibratory membrane is made of a biocompatible metal selected from the group consisting of titanium, niobium, tantalum and their alloys.

* * * * *